US009272546B2

(12) United States Patent
Kohnotoh et al.

(10) Patent No.: US 9,272,546 B2
(45) Date of Patent: Mar. 1, 2016

(54) SHEET FEEDING APPARATUS

(71) Applicant: CANON KABUSHIKI KAISHA, Tokyo (JP)

(72) Inventors: Atsushi Kohnotoh, Kawasaki (JP); Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/790,172

(22) Filed: Jul. 2, 2015

(65) Prior Publication Data

US 2016/0016418 A1 Jan. 21, 2016

(30) Foreign Application Priority Data

Jul. 18, 2014 (JP) ..... 2014-147835

(51) Int. Cl.

| | |
|---|---|
| ***B41J 2/01*** | (2006.01) |
| ***B65H 5/22*** | (2006.01) |
| ***B65H 3/44*** | (2006.01) |
| ***B65H 7/02*** | (2006.01) |
| ***B41J 13/00*** | (2006.01) |
| ***B41J 11/04*** | (2006.01) |

(52) U.S. Cl.

CPC ..... *B41J 13/0009* (2013.01); *B41J 11/04* (2013.01)

(58) Field of Classification Search

CPC ..... B41J 11/0095; B65H 3/00; B65H 3/0638; B65H 3/0684; B65H 3/44; B65H 2405/3321

USPC ..... 347/104; 271/3.03, 3.14, 3.15, 3.17, 271/9.02, 9.08, 9.09, 21, 117, 164, 165, 271/171, 270, 265.01, 265.02; 400/624

See application file for complete search history.

(56) References Cited

U.S. PATENT DOCUMENTS 3,920,238 A * 11/1975 Kitajima ..... G03G 15/6502 271/114
4,577,849 A * 3/1986 Watanabe ..... B65H 3/44 271/10.13
5,177,547 A 1/1993 Kanemitsu et al.
5,565,970 A * 10/1996 Suda ..... G03G 15/6508 271/9.01
5,673,074 A 9/1997 Miyauchi et al.
5,738,452 A 4/1998 Uchida
7,857,301 B2 * 12/2010 Samoto ..... B65H 3/0684 271/9.01
7,883,282 B2 * 2/2011 Izuchi ..... B41J 3/0018 347/104
7,909,442 B2 * 3/2011 Samoto ..... B41J 2/17509 347/103
7,959,147 B2 * 6/2011 Izuchi ..... B65H 3/0669 271/10.03
8,152,167 B2 4/2012 Saito et al.
8,672,439 B2 3/2014 Suzuki et al.
8,861,050 B2 * 10/2014 Sahara ..... H04N 1/00591 271/126
2013/0001856 A1 1/2013 Uchida
2013/0221597 A1 8/2013 Kotaka

FOREIGN PATENT DOCUMENTS

JP 2013-180834 A 9/2013

* cited by examiner

*Primary Examiner* — Ahn T. N. Vo

(74) *Attorney, Agent, or Firm* — Fitzpatrick, Cella, Harper & Scinto

(57) ABSTRACT

A sheet feeding apparatus includes: a tray storing a sheet and detachably mounted on an apparatus body; a rotatable arm; a roller, provided on the arm, configured to pick up the sheet on the tray; a sensor, provided on the arm, configured to detect a physical property; and a determination unit configured to determine, based on detection by the sensor, at least any of a mounting state of the tray on the apparatus body and at least one of states of the sheet on the tray selected from the group consisting of the presence or absence of the sheet, a remaining amount of the sheet, a type of the sheet, front and back sides of the sheet, and a size of the sheet stored on the tray.

9 Claims, 12 Drawing Sheets

TABLE

| AMOUNT OF REFLECTION LIGHT (R) DETECTED BY SHEET SENSOR | SHEET STORED ON TRAY |
|---|---|
| R1 ≦ R | NO SHEET |
| R2 ≦ R < R1 | SHEET A |
| R3 ≦ R < R2 | SHEET B |
| R < R3 | SHEET C |

FIG.4

| FIG.6A |
| --- |
| FIG.6B |

| | |
|---|---|
| FIG.7A | |
| FIG.7B | |
| FIG.7C | |

SHEET FEEDING APPARATUS

BACKGROUND OF THE INVENTION

1. Field of the Invention

The present invention relates to a sheet feeding apparatus and a printing apparatus which are capable of detecting the state of a sheet-like medium on a tray.

2. Description of the Related Art

Some printing apparatus have a plurality of housing-type trays on which a sheet-like medium (hereinafter also referred to simply as a sheet) on which printing is performed is loaded. As disclosed in, for example, Japanese Patent Laid-Open No. 2013-180834, some are configured such that two trays in tiers of an upper tray and a lower tray are included, the upper tray being slidable inside a printing apparatus body, and sheets can be fed from both the upper and lower trays by one swing-arm type pickup roller.

SUMMARY OF THE INVENTION

Since a variety of sheets can be retained on a tray, loading mistakenly a wrong type of sheet or a sheet upside down may occasionally cause printing not to be performed in an optimal setting. Further, in a case where printing operation is performed without a sheet being loaded on the tray, the printing operation needs to be reset causing extra work of performing the printing operation again after the sheet is loaded. To avoid such a situation, a technique is required for enabling detection of the state of the sheet on the tray in an early stage prior to performing printing operation. Meanwhile, a large-scale means for detecting the state of the sheet causes the apparatus to be enlarged and thus is undesirable.

An object of the present invention is to provide a sheet feeding apparatus and a printing apparatus which are capable of detecting, in a simple structure, the state of a sheet on a tray.

To solve the above problem, there is provided a sheet feeding apparatus comprising a tray storing a sheet and detachably mounted on an apparatus body; a rotatable arm; a roller, provided on the arm, configured to pick up the sheet on the tray; a sensor, provided on the arm, configured to detect a physical property; and a determination unit configured to determine, based on detection by the sensor, at least any of a mounting state of the tray on the apparatus body and at least any of a mounting state of the tray on the apparatus body and at least one of states of the sheet on the tray selected from the group consisting of the presence or absence of the sheet, a remaining amount of the sheet, a type of the sheet, front and back sides of the sheet (that is, which of the front and back sides of the sheet is faced up), and a size of the sheet stored on the tray.

Further features of the present invention will become apparent from the following description of exemplary embodiments (with reference to the attached drawings).

BRIEF DESCRIPTION OF THE DRAWINGS

FIG. 4 is an example of a table showing a correlation between the amount of reflection light which is detected by the sheet sensor and the type of sheet according to the first embodiment;

DESCRIPTION OF THE EMBODIMENTS

Figure 1A:
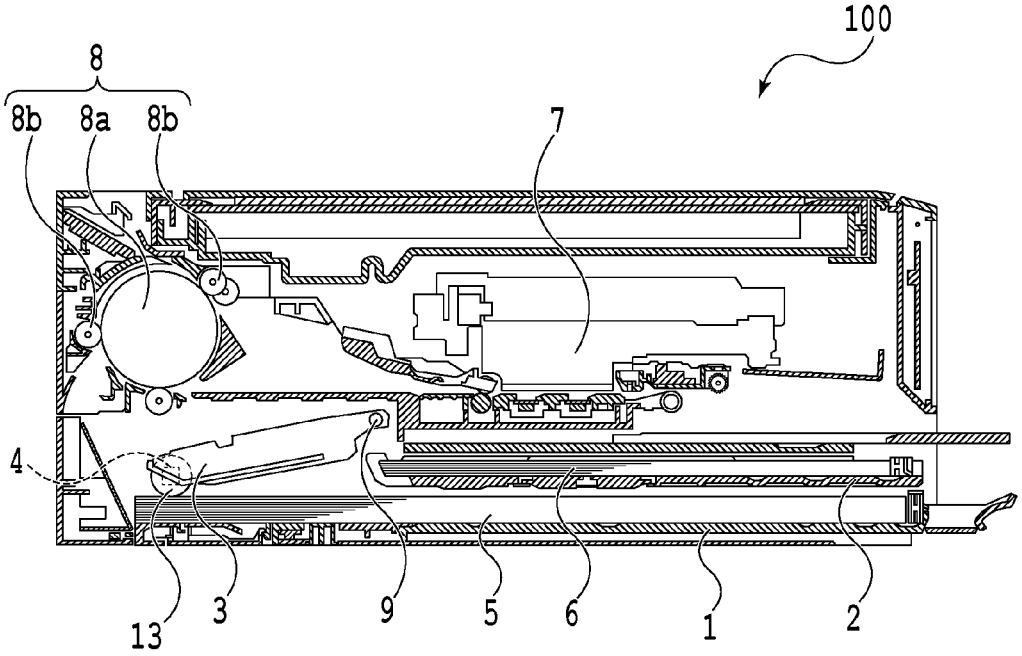
FIGS. 1A and 1B are cross-sectional views of a printing apparatus according to a first embodiment.

Embodiments according to the present invention will be specifically explained below with reference to the drawings. Identical or similar reference numerals denote identical or similar configurations throughout the drawings.

(Configuration of Printing Apparatus)

Figure 1B:
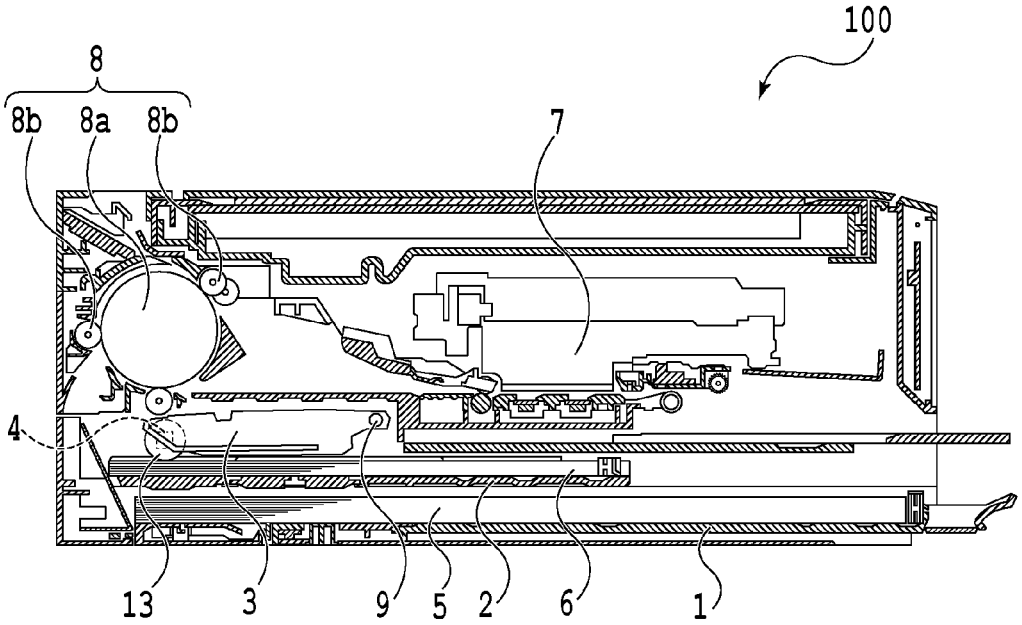

FIGS. 1A and 1B are cross-sectional views of a printing apparatus 100 according to a first embodiment of the present invention. The printing apparatus 100 has a printing unit 7 for printing characters and images on a sheet-like medium (hereinafter also referred to simply as a sheet), a conveying unit for conveying a sheet to the printing unit 7, and a sheet feeding unit for feeding, to the conveying unit, the sheet to be conveyed by the conveying unit. The printing apparatus 100 further has a control substrate (controller) for controlling operations of driving units.

The printing unit 7 may be configured such that significant information such as characters and graphics, and both significant and insignificant images, designs, patterns, and the like can be formed on the sheet-like medium, and the printing system is not specifically limited.

The printing unit 7, for example, may be configured to eject liquid (ink) on the sheet by employing an ink jet system. Further, the sheet-like medium, made of/from any material or in any form, on which printing is performed by the printing unit 7, may be used, as long as the medium is a sheet-like medium on which characters, images, and the like can be printed, including paper, cloth, a plastic sheet, an OHP sheet, and an envelope.

The conveying unit has a plurality of conveyance roller pairs 8, each having a conveyance roller 8*a* for conveying the sheet by rotation and a driven roller 8*b* which is driven and rotated in association with the conveyance roller 8*a*. The sheet fed from the sheet feeding unit is conveyed to the printing unit 7 by being sandwiched between the rollers of the conveyance roller pairs 8.

The sheet feeding unit has two trays in tiers of an upper tray and a lower tray, whose sheet loading surfaces are loaded with and store sheets on which printing is to be performed by the printing unit 7, the two trays in tiers being detachably mounted on a printing apparatus body, and a pickup roller unit 3 which picks one sheet out of the trays. The tray may be called a cassette.

The pickup roller unit 3 has an arm rotatably mounted on a rotation support unit 9 and a pickup roller 13 which is rotatably provided on a free end of the arm and which feeds the sheet in contact by picking it up by rotation.

Figure 2:
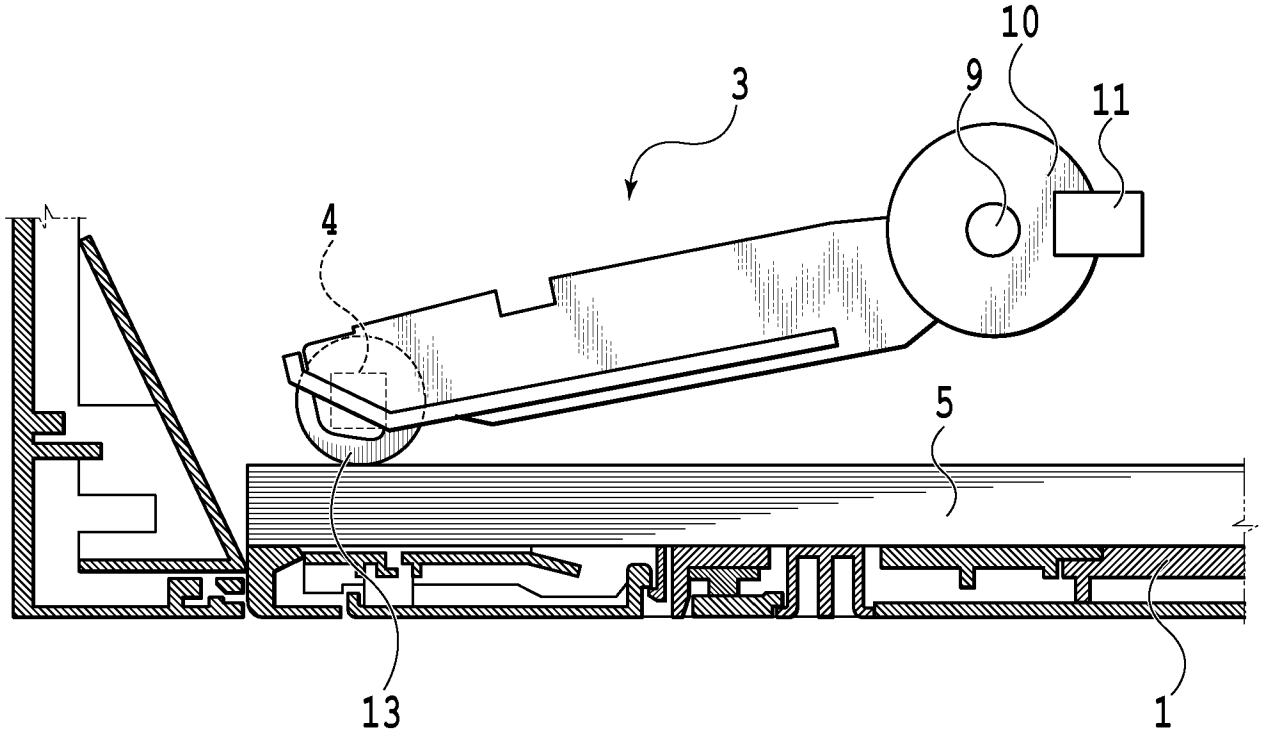
FIG. 2 is a view showing an example of a configuration of a pickup roller unit according to the first embodiment.

As shown in FIG. 2, the pickup roller unit 3 has a detector (rotation angle sensor) which moves in association with the rotation of the arm, the detector having an optical scale 10 and an optical encoder 11, and is capable of detecting its own rotation angle as the state of the rotation. Further, the pickup roller unit 3 is provided with a sheet sensor 4 capable of detecting the state of the sheet.

Figure 3:
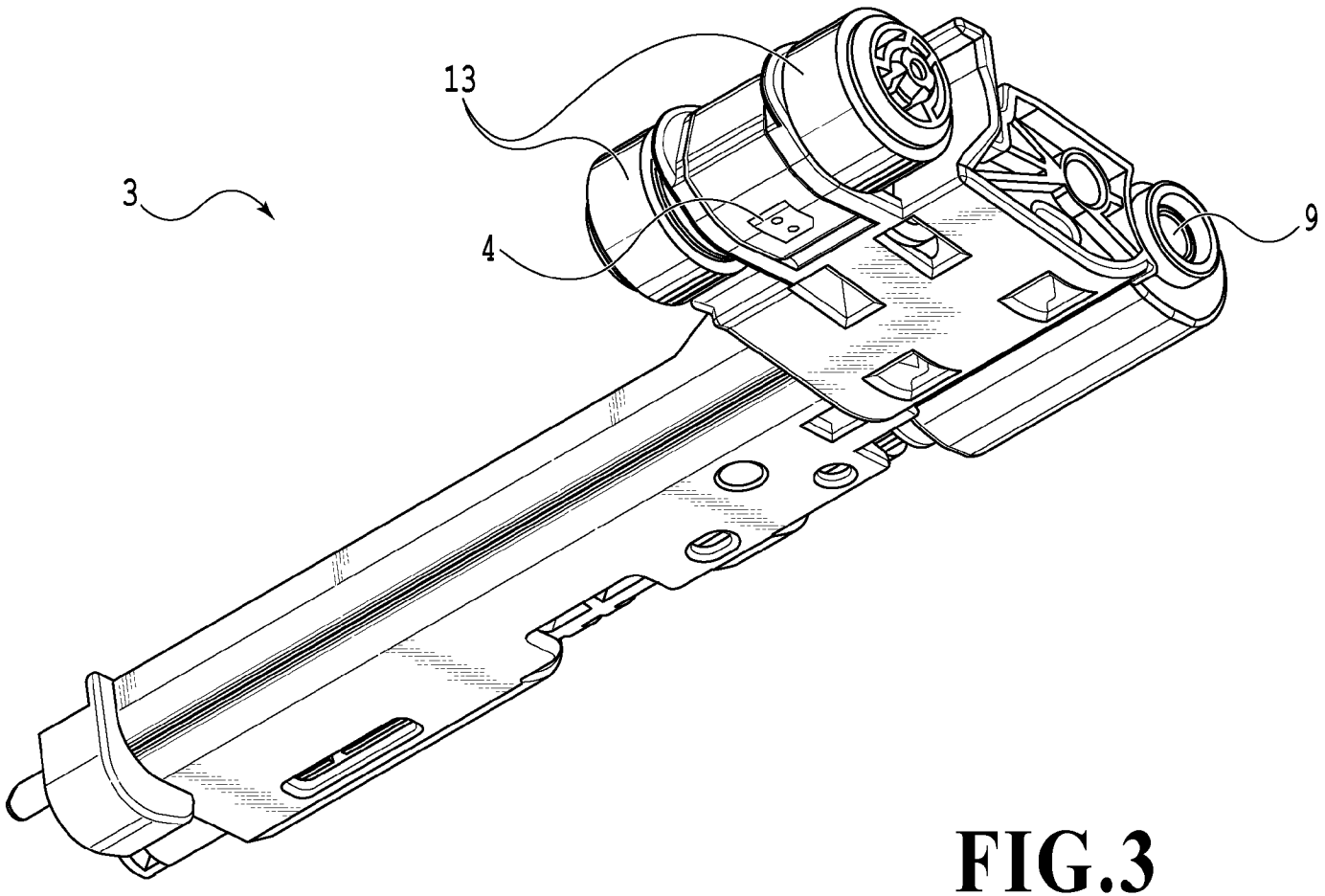
FIG. 3 is a view showing an example of an arrangement of a sheet sensor on the pickup roller unit according to the first embodiment.

As the sheet sensor 4, any of known sensors which allow the sheet to be determined by a physical property detected by the sensor may be employed. In this example, the sheet sensor 4 is a photoelectric sensor having a light irradiating unit and a light receiving unit, wherein a surface to be detected is irradiated with light from the light irradiating unit and reflection light from the surface to be detected is received at the light receiving unit, thereby enabling measurement of an amount of reflection light. The pickup roller unit 3 is configured such that the sheet sensor 4 can detect the physical property of the surface to be detected in a posture in which the pickup roller 13 has been brought into contact with the surface to be detected. The position of the sheet sensor 4 to be mounted on the pickup roller unit 3 is preferably, but not limited to, between a plurality of pickup rollers 13 or near the pickup roller 13 as shown in, for example, FIG. 3. This is because in a detecting posture, the distance between the sheet sensor 4 and the surface to be detected is small, thereby enabling detection with high precision.

Refer back to FIGS. 1A and 1B. Of the two trays in tiers of the upper tray and the lower tray, a lower tray 1 and an upper tray 2 thereabove store Sheet 5 and Sheet 6, respectively. The upper tray 2 is configured to be slidable, by means of a driving source (not shown), between a first position as shown in FIG. 1A and a second position as shown in FIG. 1B inside the printing apparatus body. The control substrate can determine that in a case where the upper tray 2 is set in the first position, the sheet can be fed from the lower tray 1 and that in a case where the upper tray 2 is set in the second position, the sheet can be fed from the upper tray 2.

(Operation Sequence of Printing Apparatus)

Next, with reference to a flowchart shown in FIGS. 6A and 6B, an operation sequence of the printing apparatus 100 from detection of the state of the sheet on the tray to starting printing operation will be explained.

Figures 6, 6A:
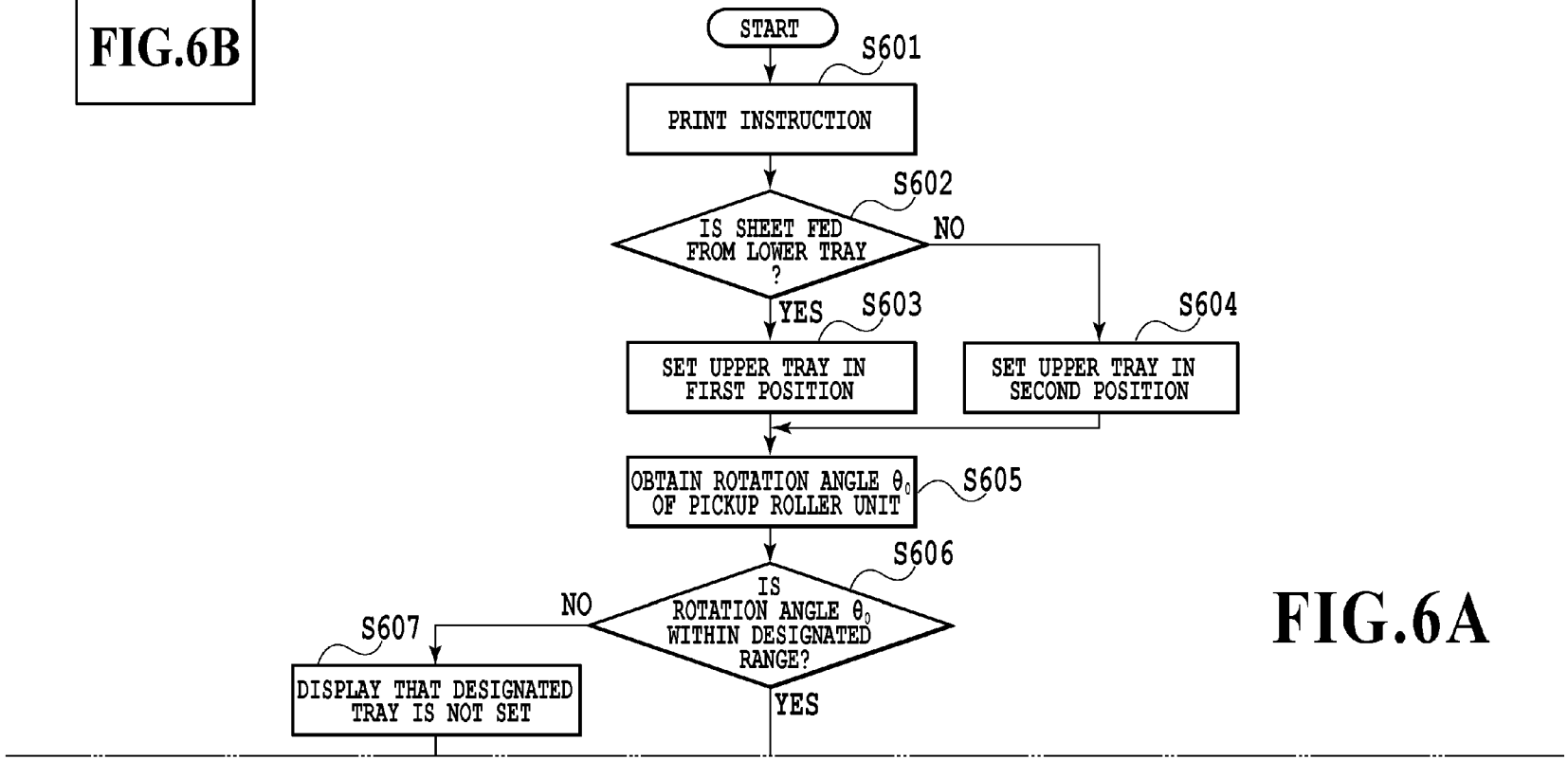
FIG. 6 is a diagram showing the relationship between FIGS. 6A and 6B.
FIGS. 6A and 6B show an example of operation sequence from detection of the state of a sheet on a tray to performing printing operation according to the first embodiment.

Referring to FIG. 6A, once a print instruction is issued in step S601, it is determined which of the two trays in tiers of the upper tray and the lower tray is designated by the print instruction to feed the sheet. In a case where the sheet is to be fed from the lower tray 1, the process proceeds to step S603, and in a case where the sheet is to be fed from the upper tray 2, the process proceeds to step S604.

In step S603, the upper tray 2 is set in the first position shown in FIG. 1A and the pickup roller 13 of the pickup roller unit 3 contacts the top surface of the lower tray 1. On the other hand, in step S604, the upper tray 2 is set in the second position shown in FIG. 1B and the pickup roller 13 of the pickup roller unit 3 contacts the top surface of the upper tray 2. In the present specification, the top surface of the tray means the upper surface of a sheet at the top of the sheets loaded on the sheet loading surface of the tray in a case where the sheets are stored on the tray, and means the sheet loading surface of the tray in a case where no sheet is stored on the tray.

((Detection of Presence or Absence of Tray))

Next, in step S605, a rotation angle $\theta_0$ from a reference posture of the pickup roller unit 3 at the time when the pickup roller 13 contacts the top surface of the tray in step S603 or S604 is obtained to be stored in a memory of the control substrate.

A rotation angle $\theta_1$ from the reference posture of the pickup roller unit 3 at the time when the pickup roller 13 contacts the top surface of the lower tray 1 with no sheet stored on the lower tray 1 is prerecorded in the control substrate. Similarly, a rotation angle $\theta_2$ from the reference posture of the pickup roller unit 3 at the time when the pickup roller 13 contacts the top surface of the upper tray 2 with no sheet stored on the upper tray 2 is prerecorded in the control substrate.

For convenience of explanation, a case where the pickup roller 13 contacts the top surface of the lower tray 1, that is, a case where the process proceeds to step S605 through steps S602 and S603 will be described below.

In step S606, the rotation angle $\theta_0$ obtained in step S605 is compared with the rotation angle $\theta_1$ recorded in the control substrate. In a case where the size relation of the rotation angles satisfies $\theta_0>\theta_1$, it is determined that the lower tray 1 is not set in a predetermined position, and the process proceeds to step S607. In step S607, an interface (not shown) displays that the tray designated by a print instruction is not mounted on the printing apparatus body and the operation sequence ends. On the other hand, in a case where the size relation of the rotation angles satisfies $\theta_0\leq\theta_1$, it is determined that the lower tray 1 is set in the predetermined position and the process proceeds to step S608 shown in FIG. 6B.

((Detection of Presence or Absence of Sheet, Type of Sheet, and Front and Back Sides of Sheet))

Figure 6B:
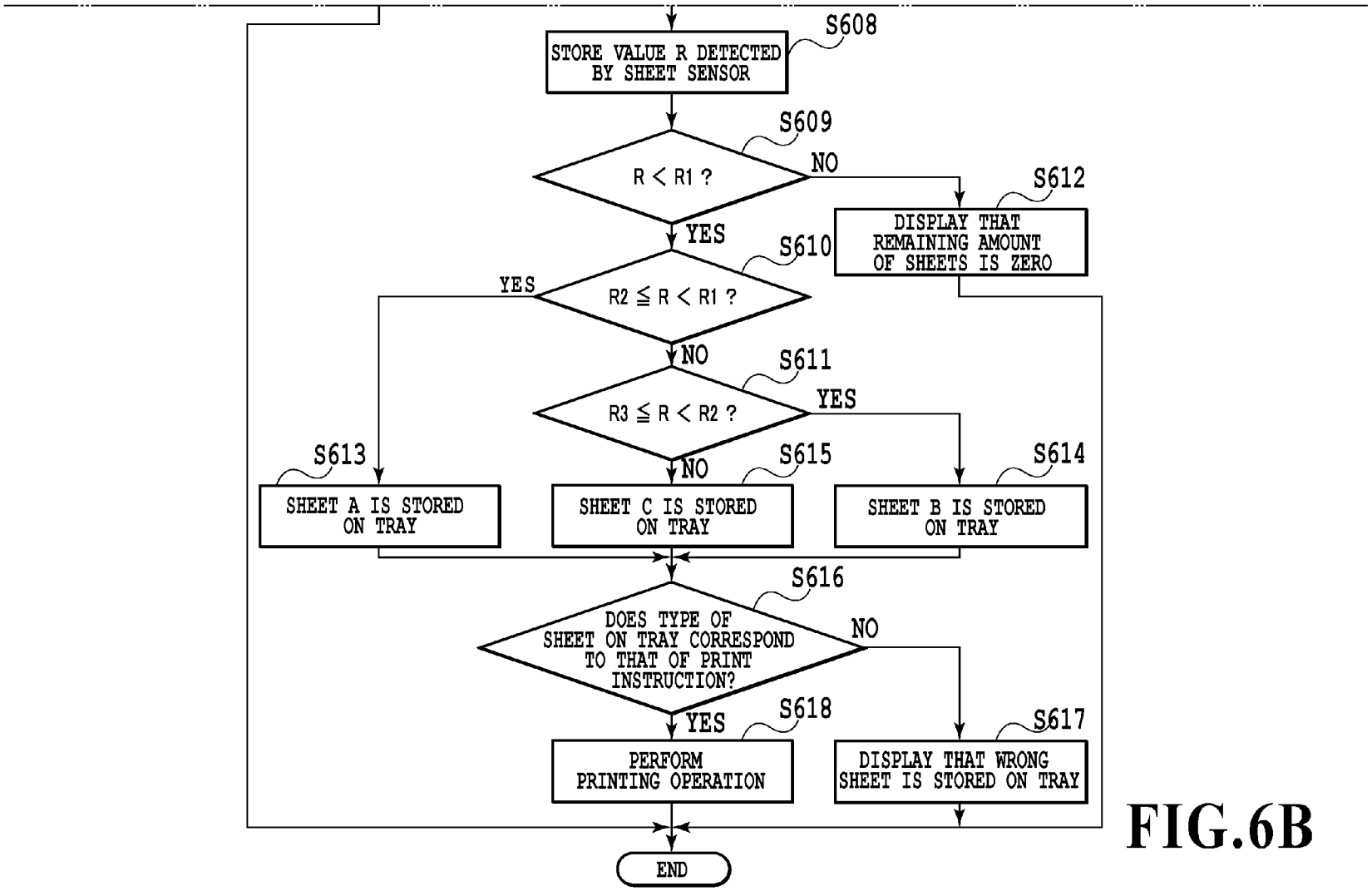

Referring to FIG. 6B, in step S608, the sheet sensor 4 detects the state of the sheet on the lower tray 1. Detection of the state of the sheet on the tray can be performed as explained below.

FIG. 4 is an example of a table showing a correlation between the range of values of an amount of reflection light R obtained in a case where the sheet sensor 4 performs detection operation and the type of sheet stored on the tray. For example, in a case where an obtained value of the amount of the reflection light R is R3 or more and less than R2, according to the correlation shown in the table, the type of sheet stored on the tray is determined to be Sheet B. This type of table is prepared for each of the trays and is prerecorded in the control substrate.

Referring back to FIG. 6B, in step S608, the sheet sensor 4 performs operation of detecting the amount of the reflection light in a posture in which the pickup roller 13 contacts the top surface of the lower tray 1, and the detected amount of the reflection light R is stored in the memory of the control substrate.

Next, in steps S609 to S611, the detected amount of the reflection light R is compared with data recorded in the table, thereby enabling the determination of the presence or absence or type of sheet stored on the tray.

The explanation will be made in more detail. In step S609, in a case where the detected amount of the reflection light R is a first threshold R1 defining a range of the amount of reflection light recorded in the table or higher (that is, R≥R1), the process proceeds to step S612. In step S612, it is determined that no sheet is stored on the tray and the interface (not shown) displays that the remaining amount of sheets is zero, and the operation sequence ends. On the other hand, in a case where the amount of the reflection light R is less than the first threshold R1 (that is, R<R1), the process proceeds to step S610.

In step S610, further, in a case where the detected amount of the reflection light R is a second threshold R2 defining a range of the amount of the reflection light recorded in the table or higher (that is, R2≤R<R1), the process proceeds to step S613. In step S613, it is determined that Sheet A is stored on the lower tray 1, and the process then proceeds to step S616. On the other hand, in a case where the amount of the reflection light R is less than the second threshold R2 (that is, R<R2), the step proceeds to step S611.

In step S611, further, in a case where the amount of the reflection light R is a third threshold R3 defining a range of the amount of the reflection light recorded in the table or higher (that is, R3≤R<R2), the process proceeds to step S614. In step S614, it is determined that Sheet B is stored on the lower tray 1, and the process proceeds to step S616. On the other hand, in a case where the amount of the reflection light R is less than the third threshold R3 (that is, R<R3), the process proceeds to step S615. In step S615, it is determined that Sheet C is stored on the lower tray 1, and the process then proceeds to step S616.

In step S616, determination is made as to whether the type of sheet designated by the print instruction in step S601 corresponds to the type of sheet on the lower tray 1 which is determined in steps S613 to S615 based on the detection by the sheet sensor 4 in step S608. In a case where the types of the sheets are not determined to correspond to each other, the process proceeds to step S617, the interface (not shown) displays an error message indicating that a wrong type of sheet is stored on the tray, and the operation sequence ends. On the other hand, in a case where the types of the sheets are determined to correspond to each other, it is determined that Sheet 5 is correctly stored on the lower tray 1, and the process proceeds to step S618.

((Performing Printing Operation))

In step S618, printing operation is performed. More specifically, printing operation is performed including sheet feeding in which one sheet out of Sheet 5 is taken out of the lower tray 1 by the pickup roller unit 3, sheet conveyance in which the fed sheet is conveyed via the conveyance roller pair 8, and performing printing on the conveyed sheet by the printing unit 7.

For convenience sake, the above explanation is made about a case where the pickup roller 13 contacts the top surface of the lower tray 1, but the same explanation applies to a case where the pickup roller 13 contacts the top surface of the upper tray 2. In both cases, the presence or absence of the tray is determined in steps S605 to S607, and in a case the tray is present, the state of the sheet on the tray is detected in steps S608 to S615, and based on the results, printing operation is performed.

In the above manner, according to the present embodiment, it is possible, prior to performing printing operation, to detect the states in which no tray is mounted on the printing apparatus body, the remaining amount of the sheets on the tray is zero, and the sheet of a type different from that of a print instruction is stored on the tray. In other words, prior to feeding the sheets stored on the tray by picking them up one by one by the roller, determination is made by a determination unit.

For convenience of explanation, FIG. 4 shows an example of a table used for performing detection of three types of sheets. In this example, the states of the sheet on the tray, which are the presence or absence of the sheet stored on the tray and the type of sheet on the tray, if any, can be detected. It may also be possible, by subdividing the threshold in the range of the amount of the reflection light, to detect more types of sheets, and front and back sides of a sheet, that is, which side of a double-sided sheet is faced up.

((Detection of Remaining Amount of Sheet))

As another example of the states of the sheet on the tray that can be detected in the present embodiment, a method of detecting the remaining amount of sheets stored on the tray will be explained. For convenience sake, the explanation is made about the operation of detecting the remaining amount of Sheet 5 on the lower tray 1, but the same explanation applies to the operation of detecting the remaining amount of Sheet 6 on the upper tray 2.

As stated above, the rotation angle $\theta_1$ from the reference posture of the pickup roller unit 3 at the time when no sheet is stored on the lower tray 1 (the remaining amount of the sheets is zero) is prerecorded in the control substrate. Further, data on the thickness of one sheet per each type of sheet is prerecorded in the control substrate.

Referring to FIG. 6A, in step S605, the rotation angle $\theta_0$ from the reference posture of the pickup roller unit 3 at the time when the pickup roller 13 contacts Sheet 5 on the lower tray 1 is obtained. In this case, an angle displacement amount $(\theta_1-\theta_0)$ from the rotation angle $\theta_1$ is obtained. By referring to the correlation between the obtained angle displacement amount $(\theta_1-\theta_0)$ and the corresponding number of sheets of that type, the remaining amount of the sheets stored on the tray can be obtained by the number of sheets.

The type of the sheet stored on the tray to be used for obtaining the remaining amount of the sheets can be determined by the detection by the sensor as described above (see steps S608 to S615 in FIG. 6B), or the type of sheet designated by a print instruction may be used.

Similarly, the remaining amount of the sheets on the upper tray 2 also can be detected by using the angle displacement amount $(\theta_2-\theta_0)$ from the rotation angle $\theta_2$.

According to the present embodiment, the simple configuration in which the pickup roller unit which is a mechanism for sheet feeding is used enables detection of the presence or absence of the tray and the state of the sheet on the tray at a stage prior to starting the sheet feeding from the tray before performing printing operation, thereby making it possible to prevent poor quality of a print image due to loading a wrong type of sheet or setting a sheet upside down and wasteful printing operation due to sheet supply to the tray being forgotten or the like. Further, since one sensor common to both of the upper and lower trays can detect both the trays, stable detection is enabled due to no influence by sensitivity dispersion among different sensors compared to a case where the two trays in tiers of the upper tray and the lower tray are each provided with a sensor. Furthermore, increase in cost and size of the apparatus can be controlled.

Figure 9:
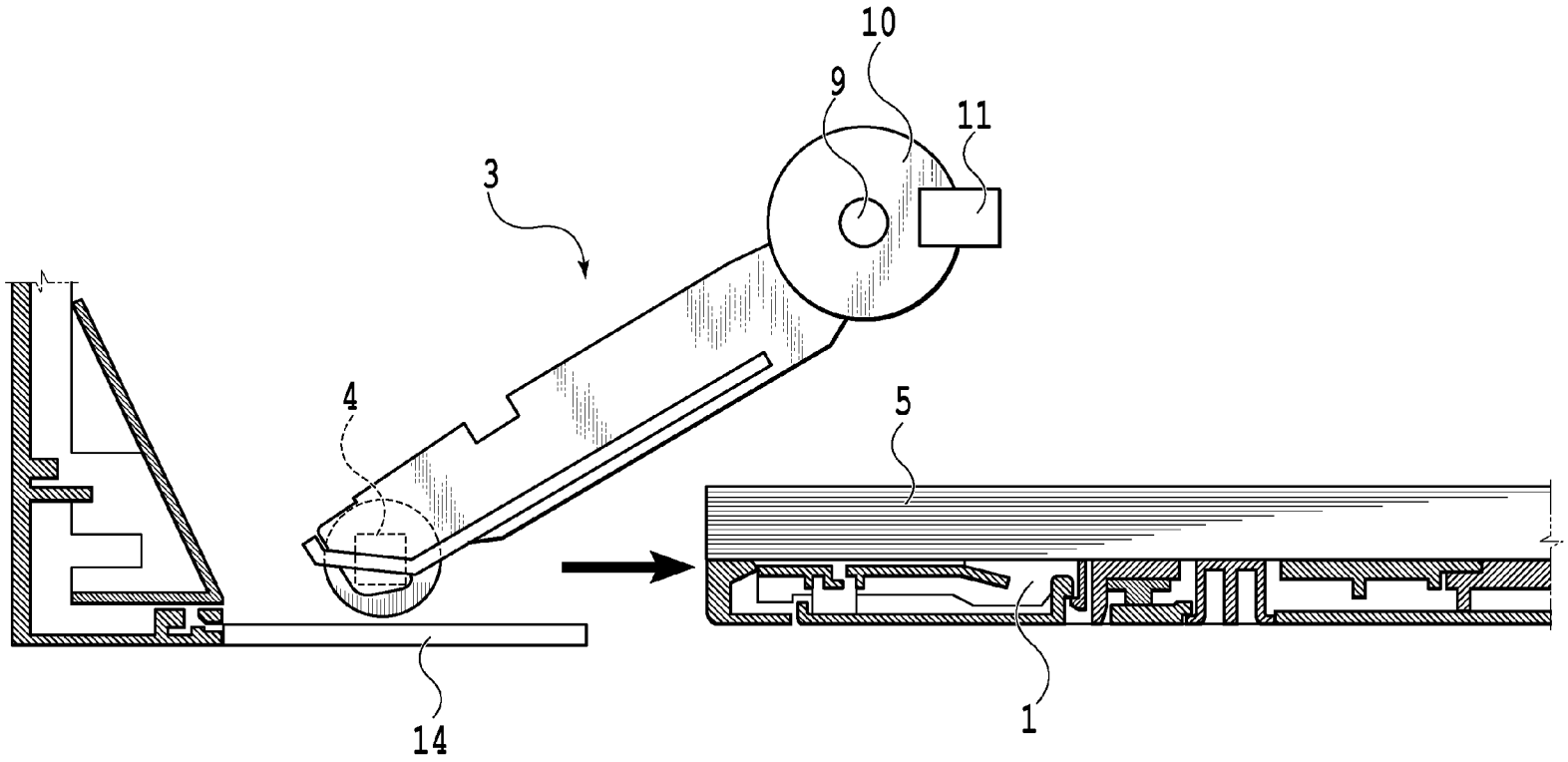
FIG. 9 is a view showing an example of a configuration in which presence or absence of the tray is detected by means of a reflector according to the second embodiment.

With reference to FIG. 9, a second embodiment of the present invention is explained below. The explanations of the same configurations and effects as those of the first embodiment are omitted and distinctive matters only will be explained.

(Detection of Presence or Absence of Tray)

In the first embodiment, the rotation angle of the pickup roller unit 3 is obtained, and the state of the tray being not set on the printing apparatus body is detected by the fact that the obtained rotation angle is not within the preset range (see steps S605 to S607 of FIG. 6A). The second embodiment is an example of a configuration in which the state in which the lower tray 1 has been removed is detected by detecting the amount of the reflection light by using the sheet sensor 4 and a reflector in combination, instead of the configuration of the first embodiment.

(Configuration of Apparatus)

In an example of a configuration shown in FIG. 9, a reflector 14 is provided lower than the lower tray 1. In a case where there is no tray between the pickup roller 13 and the reflector 14, the pickup roller 13 of the pickup roller unit 3 contacts the reflector 14. Once detection operation is performed by the sheet sensor 4 in a posture in which they contact with each other, the reflector 14 is detected. The detected amount of the reflection light of the reflector 14 is prerecorded in the control substrate.

(Operation Sequence of Apparatus)

An example of an operation sequence (not shown) of the printing apparatus 100 according to the second embodiment will be explained. Once a print instruction is issued, based on the print instruction, control is performed so as to set the upper tray 2 in the first position or the second position. Next, the sheet sensor 4 detects the amount of the reflection light by setting a surface which the pickup roller 13 contacts to be a surface to be detected.

In a case where the detected amount of the reflection light equals the prerecorded amount of the reflection light of the reflector 14, if control is performed so as to set the upper tray 2 in the first position based on the print instruction, it is determined that the lower tray 1 is removed from the printing apparatus body, and if control is performed so as to set the upper tray 2 in the second position based on the print instruction, it is determined that both of the lower tray 1 and the upper tray 2 are removed from the printing apparatus body.

In a case where it is determined that the tray is removed from the printing apparatus body, the interface (not shown) displays that the designated tray is not mounted and the operation sequence ends.

According to the present embodiment, the steps and configurations in relation to obtaining of the rotation angles in the operation sequence of the printing apparatus according to the first embodiment may be omitted.

With reference to FIGS. 5 to 7C, a third embodiment according to the present invention will be explained below. The explanations of the same configurations and effects as those of the first embodiment are omitted and distinctive matters only will be explained.

(Detection of Sheet Size)

In the first embodiment, the single sheet sensor 4 detects the states of the sheet such as the presence or absence and type of the sheet on the tray (see FIG. 3 and steps S608 to S615 of FIG. 6B), while in the third embodiment, a group of sheet sensors 12 comprising a plurality of sheet sensors 4 is mounted, whereby the sheet size is detected.

(Configuration of Apparatus)

Figure 5:
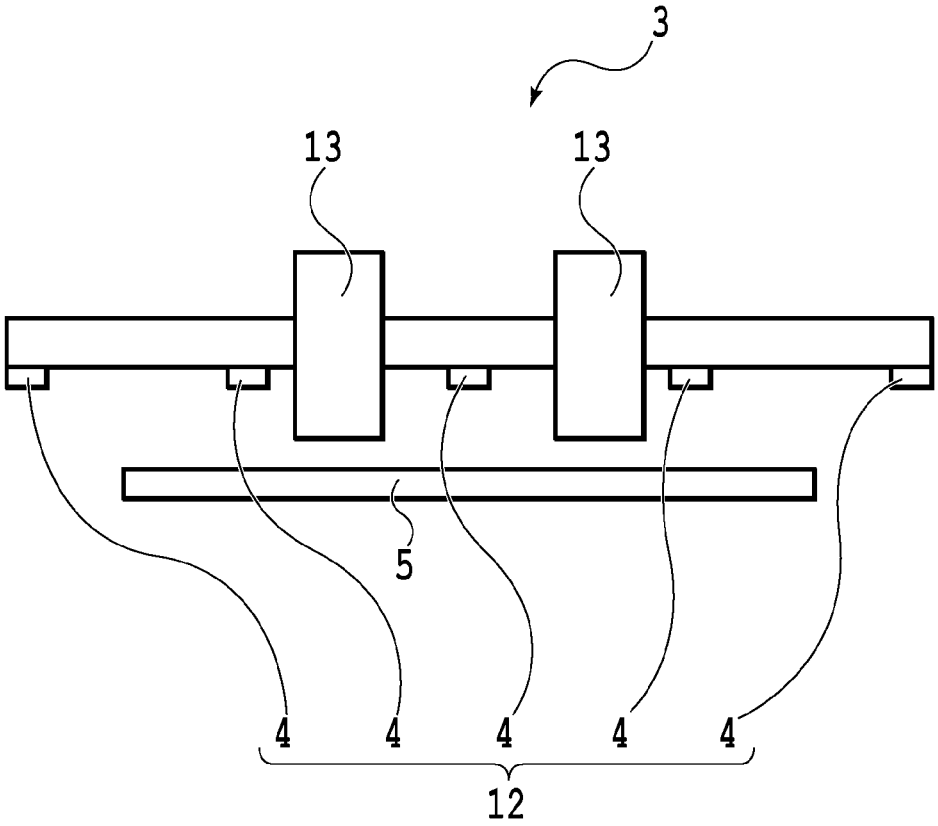
FIG. 5 is a front view showing an example of a configuration of a pickup roller unit having a plurality of sheet sensors according to a second embodiment.

FIG. 5 is a schematic view of a tip end of the free end of the arm of the pickup roller unit 3 according to the third embodiment as viewed from the pickup roller 13 toward the rotation support unit 9. In this example, the pickup roller unit 3 has a plurality of sheet sensors 4 disposed near the pickup roller 13 at a predetermined interval in a width direction of a sheet. For convenience of explanation, the pickup roller unit 3 has five sheet sensors 4.

(Operation Sequence of Apparatus)

Figures 7, 7A:
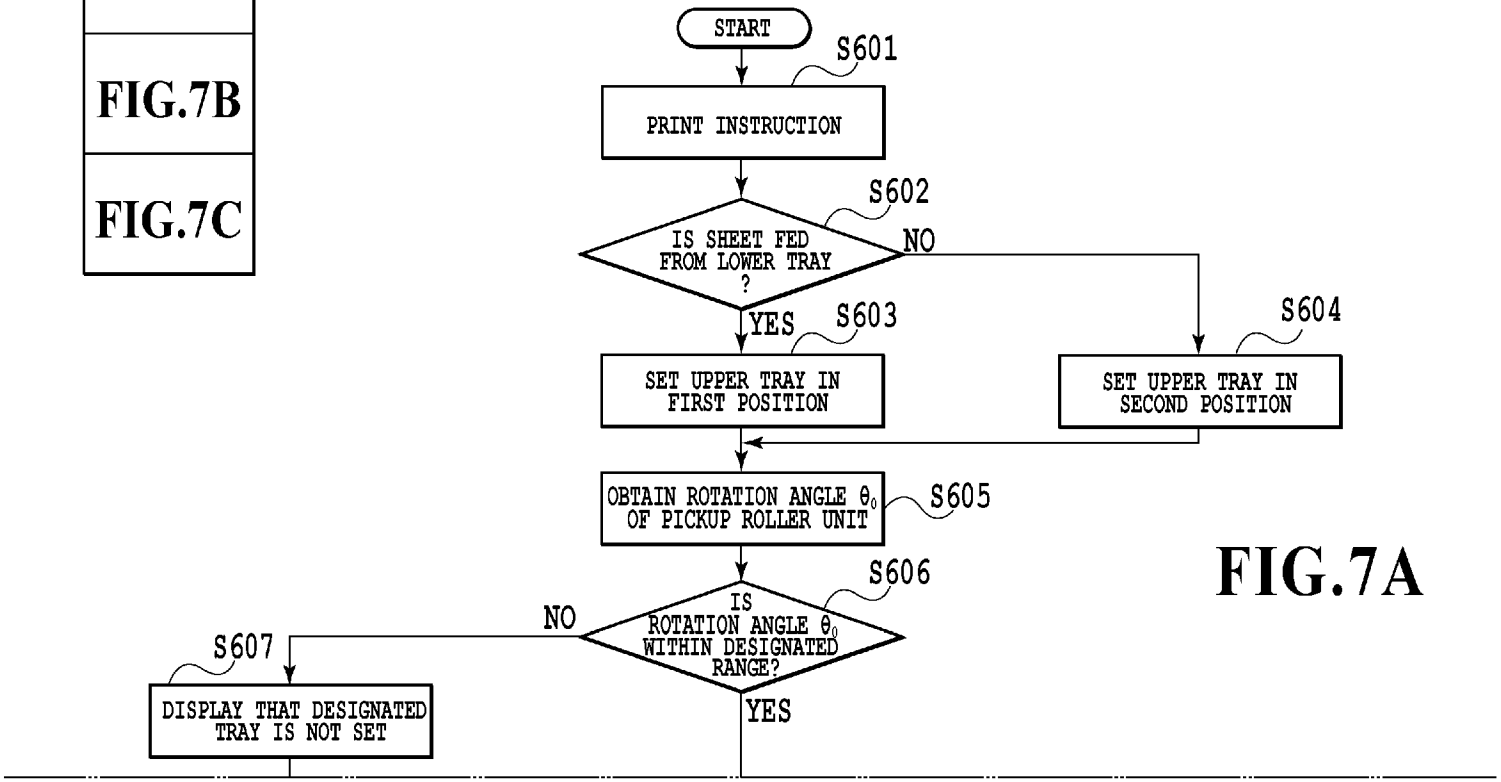
FIG. 7 is a diagram showing the relationship among FIGS. 7A, 7B, and 7C.
FIGS. 7A, 7B, and 7C show an example of operation sequence from detection of the size of a sheet on a tray to performing printing operation according to a third embodiment.
Figure 7B:
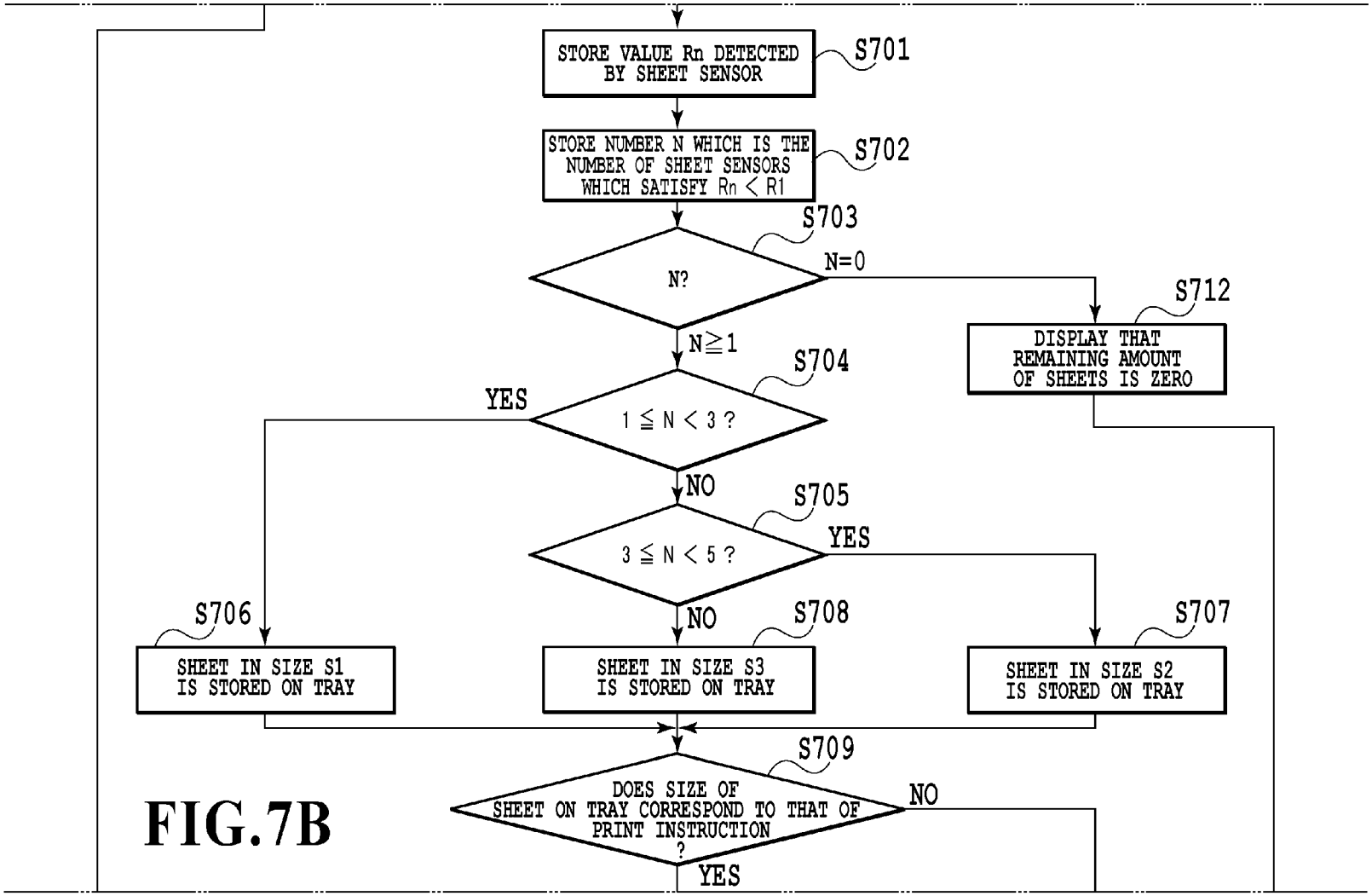
Figure 7C:
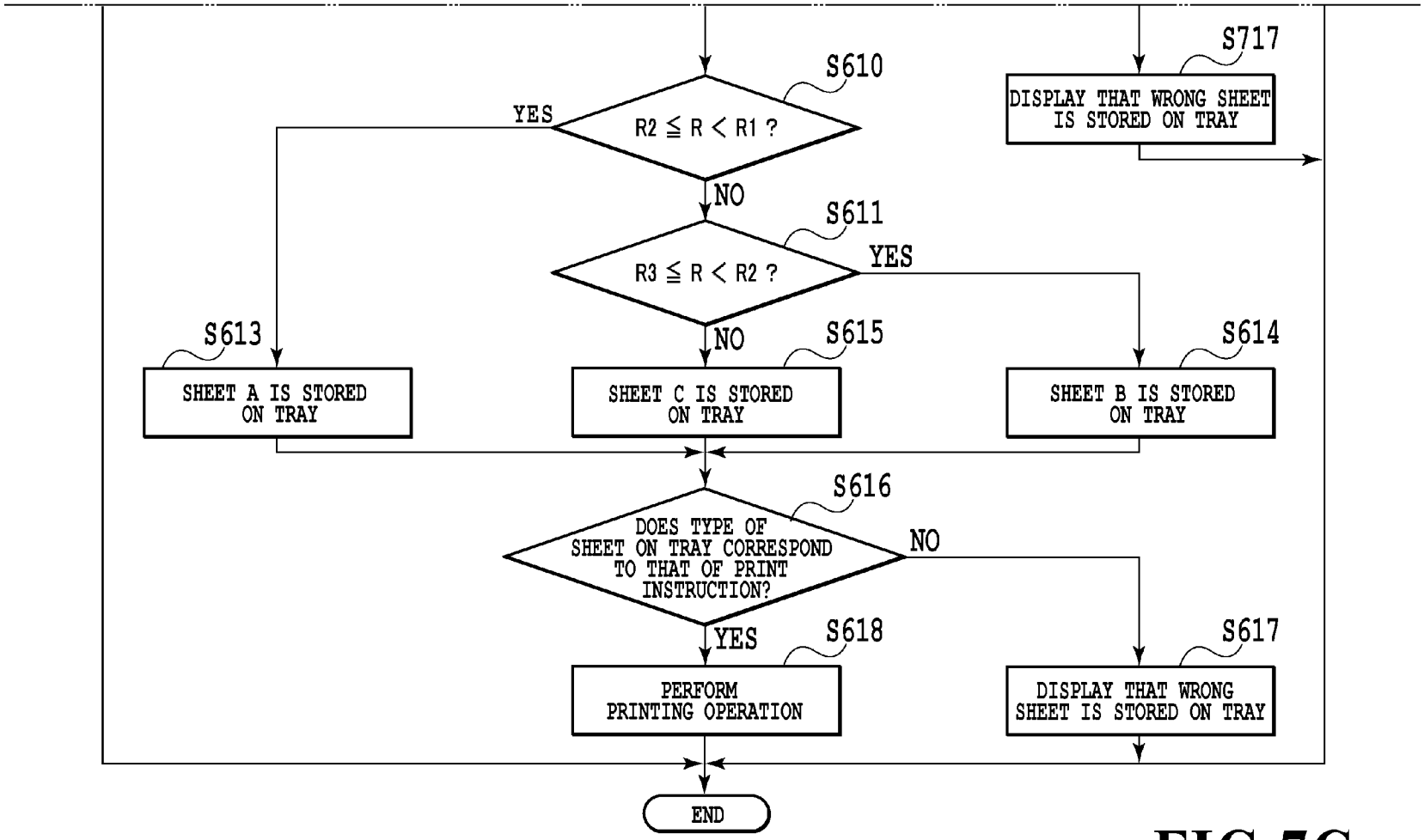

FIGS. 7A to 7C show an operation sequence from detection of the state of the sheet on the tray to printing operation performed in the printing apparatus 100 according to the third embodiment. The operation sequence according to the third embodiment shown in FIGS. 7A to 7C will be explained by focusing on differences from the operation sequence according to the first embodiment shown in FIGS. 6A and 6B. Identical or similar reference numerals in the drawings denote identical or similar steps.

In the first embodiment, in step S606, in a case where the size relation of the rotation angles satisfies $\theta_0 \leq \theta_1$, the process proceeds to step S608 in FIG. 6B and the single sheet sensor 4 performs operation of detecting the top surface of the tray, while in the third embodiment, the process proceeds to step S701 in FIG. 7B and the plurality of sheet sensors 4 (five in this example) included in the group of sensors 12 perform the detection operation and the amount of the reflection light Rn (n=1, 2, . . . , 5) detected by each of the sensors is stored in the memory of the control substrate.

Next, in step S702, the amounts of the reflection light Rn (n=1, 2, . . . , 5) detected in step S701 are each compared with the first threshold R1 defining the range of values of the amount of the reflection light recorded in the table shown in FIG. 4. A number N which is the number of the sheet sensors 4 in which the detected amount of the reflection light Rn is less than the first threshold R1 (that is, Rn<R1) is obtained and stored in the memory of the control substrate.

Next, in step S703, in a case where the number N is zero (that is, N=0 in this example), it is determined that there is no sensor which has detected a sheet, that is, no sheet is stored on the tray, and the process proceeds to step S712. In step S712, the interface (not shown) displays that the remaining amount of the sheets is zero, and the operation sequence ends. On the other hand, in a case where the number N is not zero (that is, N≤1), the process proceeds to step S704.

Further, in step S704, in a case where the number N is less than 3 (that is, 1≤N<3), the process proceeds to step S706 and it is determined that a sheet in size S1 is stored on the tray, and the process proceeds to step S709. On the other hand, in a case where the number N is 3 or higher (that is, 3≤N), the process proceeds to step S705.

In step S705, further, in a case where the number N is less than 5 (that is, 3≤N<5), the process proceeds to step S707 and it is determined that a sheet in size S2 is stored on the tray, and the process proceeds to step S709. On the other hand, in a case where the number N is 5 or higher (that is, N=5 in this example due to the maximum number of sensors), the process proceeds to step S708. In step S708, it is determined that a sheet in size S3 is stored on the tray, and the process proceeds to step S709. In this example, the size relation satisfies the relation of size S1<size S2<size S3 represented by using the inequality sign "<."

In step S709, determination is made as to whether the sheet size designated by the print instruction in step S601 corresponds to the size of the sheet on the lower tray 1 which is determined in steps S706 to S708 based on the detection by the sheet sensors 4 in step S701.

In a case where it is determined that the sheet sizes above do not correspond to each other, the process proceeds to step S717 in FIG. 7C, the interface (not shown) displays an error message indicating that a sheet in a wrong size is stored on the tray, and the operation sequence ends. On the other hand, in a case where it is determined that the sheet sizes correspond to each other, it is determined that the sheet in a correct size is stored on the tray, and the process proceeds to step S610 in FIG. 7C.

Referring to FIG. 7C, steps after step S610 are the same as those in the first embodiment shown in FIG. 6B. Of the plurality of sheet sensors, with respect to a sheet sensor which has detected a sheet, based on the size relation between the detected amount of the reflection light Rn and the thresholds of the amounts of the reflection light, R1, R2, and R3, the type or front and back sides of the sheet can be determined.

In the third embodiment, since the plurality of sheet sensors 4 are disposed at a predetermined interval in a width direction of the sheet, the size of the sheet in a width direction can be recognized from the number N which is the number of sheet sensors which have detected the presence of the sheet. In this example, for convenience of explanation, the number of the sheet sensors is set to be five and three types of sheets are detected, but in the present embodiment, the number of the sheet sensors and the sizes of sheets are not limited to the above. By appropriately setting the number of the sheet sensors and the interval, a variety of sheet sizes can be handled.

According to the third embodiment, in addition to the effects of the invention according to the first embodiment, the sheet size can be detected as a state of the sheet on the tray, thereby preventing distortion of print layout or the like due to a mismatch between an image size of print data and the sheet size.

Figure 8:
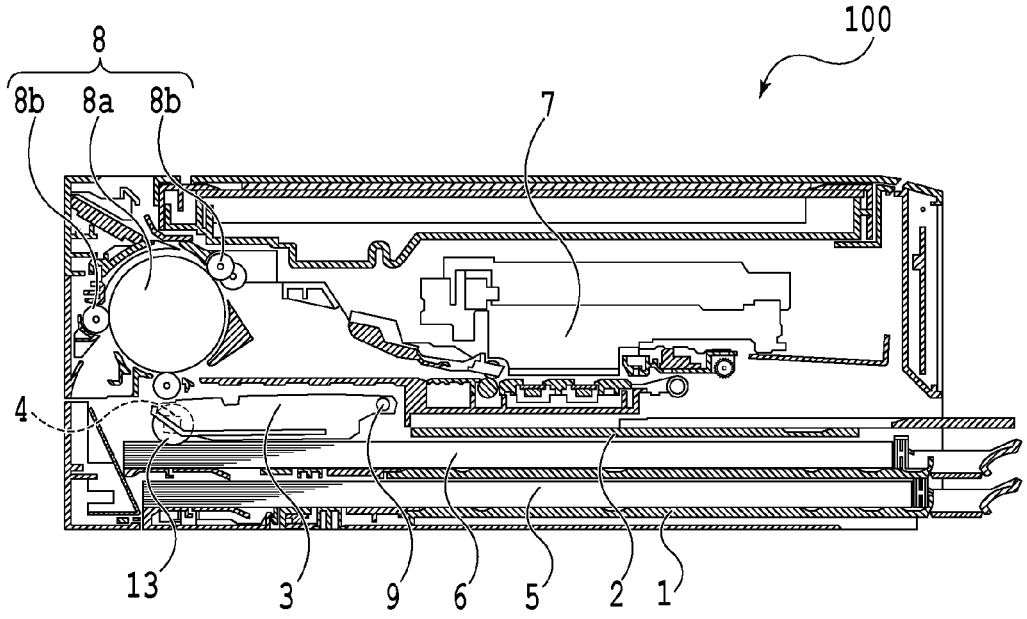
FIG. 8 is a view showing an example of a configuration in which an upper tray and a lower tray are the same in size.

The first embodiment through the third embodiment have been explained using the printing apparatus 100 which is configured such that the sheet feeding unit is provided with two trays in tiers of the upper tray and the lower tray. However, the present invention is applicable to cases having trays in any number, which may be one or a plural number which is three or more. Further, as shown in FIG. 8, the present invention is applicable to a case where the upper tray and the lower tray are the same in size. That is, the present invention is applicable irrespective of the number of trays and combinations of sizes of trays, as long as it is configured such that the pickup roller unit is provided and the pickup roller can contact the top surface of the tray.

The present invention is applicable to unit apparatuses such as a copying machine, a facsimile, a captured image forming apparatus, and a scanner, as well as a printing apparatus. Further, the present invention is not limited to these unit apparatuses, but is also widely applicable to a sheet feeding apparatus of a complex device having the above in combination or a complex device such as a computer system.

According to the present invention, it is possible to detect a mounting state of the tray on the apparatus body and the states of the sheet on the tray, such as the presence or absence of the sheet, the remaining amount of the sheets, the type of the sheet, the front and back sides of the sheet (which of a double-sided sheet is faced up), and the size of the sheet stored on the tray. However, in the present invention, determination of all of the above is not essential. The present invention encompasses also a form in which any one of the above states is determined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-147835 filed Jul. 18, 2014, which is hereby incorporated by reference wherein in its entirety.

What is claimed is:

1. A sheet feeding apparatus comprising:

a tray storing a sheet and detachably mounted on an apparatus body;

a rotatable arm;

a roller, provided on the arm, configured to pick up the sheet on the tray;

a sensor, provided on the arm, configured to detect a physical property of a surface of the sheet; and a determination unit configured to determine, based on detection by the sensor, at least any of a mounting state of the tray on the apparatus body and at least one of states of the sheet on the tray selected from the group consisting of the presence or absence of the sheet, a remaining amount of the sheet, a type of the sheet, front and back sides of the sheet, and a size of the sheet stored on the tray.

2. The sheet feeding apparatus according to claim 1, further comprising a detector configured to detect a state of rotation of the arm, wherein the determination unit performs determination based on detection by the sensor and the detector.

3. The sheet feeding apparatus according to claim 2, comprising a plurality of the trays, the plurality of the trays including an upper tray and a lower tray, wherein in response to determination by the determination unit, the roller feeds the sheets stored on any of the upper tray and the lower tray by picking up the sheets one by one.

4. The sheet feeding apparatus according to claim 1, wherein the sensor is a photoelectric sensor and detects reflection light of a surface on which the roller contacts.

5. The sheet feeding apparatus according to claim 1, comprising a plurality of the sensors, wherein the plurality of the sensors are disposed along a width direction of the sheet.

6. The sheet feeding apparatus according to claim 1, further comprising a printing unit configured to perform printing on the sheet, wherein the determination unit performs determination prior to performing feeding sheets stored on the tray by picking them up one by one by the roller.

7. A sheet feeding apparatus comprising:

an upper tray and a lower tray, each of which stores a sheet, and which are detachably mounted on an apparatus body;

a rotatable arm;

a roller, provided on the arm, configured to pick up the sheet;

a detector configured to detect a state of rotation of the arm; and a determination unit configured to determine, based on detection by the detector, at least any of mounting states of the upper tray and the lower tray on the apparatus body and at least one of states of the sheet stored on any of the upper tray and the lower tray, the states being presence or absence of the sheet and a remaining amount of the sheet.

8. The sheet feeding apparatus according to claim 7, wherein the detector has an encoder for detecting a rotation angle of the arm.

9. The sheet feeding apparatus according to claim 7, further comprising a printing unit configured to perform printing on the sheet, wherein the determination unit performs determination prior to feeding, to the printing unit, sheets stored on the tray by picking up the sheets one by one by the roller.

* * * * *